US009656851B1

(12) United States Patent
Ramphal et al.

(10) Patent No.: US 9,656,851 B1
(45) Date of Patent: May 23, 2017

(54) METHOD AND APPARATUS FOR REDUCING RESIDUAL FUEL IN A DISPENSING NOZZLE

(71) Applicant: DRAM Innovations Inc., Brampton (CA)

(72) Inventors: Devindra Ramphal, Brampton (CA); Chaitram Ramphal, Brampton (CA); Simon Oomen-Hurst, Burlington (CA)

(73) Assignee: Dram Innovations, Inc. (CA)

( * ) Notice: Subject to any disclaimer, the term of this patent is extended or adjusted under 35 U.S.C. 154(b) by 441 days.

(21) Appl. No.: 14/478,360

(22) Filed: Sep. 5, 2014

Related U.S. Application Data

(63) Continuation-in-part of application No. 13/852,170, filed on Mar. 28, 2013, now abandoned.

(60) Provisional application No. 61/873,959, filed on Sep. 5, 2013, provisional application No. 61/930,454, filed on Jan. 22, 2014, provisional application No. 61/943,676, filed on Feb. 24, 2014, provisional application No. 61/618,631, filed on Mar. 30, 2012, provisional application No. 61/676,097, filed on Jul. 26, 2012, provisional application No. 61/731,553, filed on Nov. 30, 2012.

(51) Int. Cl.
*B65B 1/04* (2006.01)
*B67D 7/52* (2010.01)
*B67D 7/04* (2010.01)

(52) U.S. Cl.
CPC ..... *B67D 7/52* (2013.01); *B67D 7/0478* (2013.01)

(58) Field of Classification Search
CPC ..... B67D 7/52; B67D 7/0478
USPC ..... 141/206
See application file for complete search history.

(56) References Cited

U.S. PATENT DOCUMENTS

| | | | |
|---|---|---|---|
| 1,554,147 | A | 9/1925 | Wager |
| 1,565,686 | A | 12/1925 | Titus |
| 1,790,625 | A | 1/1931 | Kent |
| 2,352,359 | A | 6/1944 | Anderson |
| 2,643,104 | A | 6/1953 | Holden |
| 2,978,188 | A | 4/1961 | Fredrikson |
| 3,037,536 | A | 6/1962 | Fechheimer et al. |
| 3,324,904 | A | 6/1967 | Crothers |
| 3,360,444 | A | 12/1967 | Nelson |
| 3,415,294 | A | 12/1968 | Kelly |
| 3,730,439 | A | 5/1973 | Parkison |
| 3,741,263 | A | 6/1973 | Waxlax |
| 3,792,724 | A | 2/1974 | Hunter |
| 3,811,486 | A | 5/1974 | Wood |

(Continued)

FOREIGN PATENT DOCUMENTS

| | | |
|---|---|---|
| AU | 2003275220 | 5/2005 |
| WO | WO2005039981 | 5/1995 |

OTHER PUBLICATIONS

Graco Instructions Part List, High Pressure Fluid Line: Ball Valves, Check Valves, and Swivels; 306861AJ: C. 1993; Gradco inc. Minneapolis, MN 55440-1441; 18 pages.

(Continued)

*Primary Examiner* — Jason K Niesz
(74) *Attorney, Agent, or Firm* — Duane C. Basch; Basch & Nickerson LLP

(57) ABSTRACT

Disclosed is a method and apparatus for the dispensing of liquids (e.g., fuel) where the apparatus and method include an improved nozzle that reduces residual liquid retained in the nozzle when dispensing is stopped.

18 Claims, 8 Drawing Sheets

(56) References Cited

U.S. PATENT DOCUMENTS

| | | | |
|---|---|---|---|
| 3,834,430 | A | 9/1974 | Fechheimer |
| 3,870,089 | A | 3/1975 | Laub |
| 3,923,425 | A | 12/1975 | Porter et al. |
| 4,009,739 | A | 3/1977 | Weatherford |
| 4,015,647 | A | 4/1977 | Nelson |
| 4,017,282 | A | 4/1977 | Zahka |
| 4,119,276 | A | 10/1978 | Nelson |
| 4,125,139 | A | 11/1978 | Guertin et al. |
| 4,139,031 | A | 2/1979 | Wood et al. |
| 4,203,478 | A | 5/1980 | Saito et al. |
| 4,213,488 | A | 7/1980 | Pyle |
| 4,214,614 | A | 7/1980 | Pyle |
| 4,512,379 | A | 4/1985 | Hennig |
| 4,579,152 | A | 4/1986 | Myklebust et al. |
| 4,606,382 | A | 8/1986 | Biller et al. |
| 4,711,277 | A | 12/1987 | Clish |
| 4,730,786 | A | 3/1988 | Nelson |
| 4,749,010 | A | 6/1988 | Petell |
| 4,860,804 | A | 8/1989 | Yamaguchi et al. |
| 4,877,160 | A | 10/1989 | Derving |
| 4,958,669 | A | 9/1990 | Ohta |
| 5,188,289 | A | 2/1993 | Pesho |
| 5,193,593 | A | 3/1993 | Denis et al. |
| 5,255,720 | A | 10/1993 | McPherson |
| 5,335,862 | A | 8/1994 | Esper |
| 5,377,729 | A | 1/1995 | Reep |
| 5,437,316 | A | 8/1995 | McPherson |
| 5,474,115 | A | 12/1995 | Fink, Jr. |
| 5,603,364 | A | 2/1997 | Kerssies |
| 5,605,288 | A | 2/1997 | McDonald |
| 5,620,032 | A | 4/1997 | Dame |
| 5,645,116 | A | 7/1997 | McDonald |
| 5,799,841 | A | 9/1998 | Wirt |
| 5,819,823 | A | 10/1998 | Brandstrom |
| 5,967,385 | A * | 10/1999 | Coates, III ..... B67D 7/421 141/206 |
| 6,041,834 | A | 3/2000 | Fujikawa et al. |
| 6,305,438 | B1 | 10/2001 | Sjoholm et al. |
| 6,520,222 | B2 | 2/2003 | Carmack et al. |
| 6,701,979 | B2 | 3/2004 | Servadei et al. |
| 6,854,491 | B1 | 2/2005 | Knight et al. |
| 6,941,984 | B2 | 9/2005 | Knight et al. |
| 6,983,772 | B1 | 1/2006 | Lawrence et al. |
| 6,997,220 | B1 | 2/2006 | Knight et al. |
| 7,036,536 | B1 | 5/2006 | Knight et al. |
| 7,134,580 | B2 | 11/2006 | Garrison |
| 7,270,154 | B2 | 9/2007 | Walker et al. |
| 7,594,616 | B2 | 9/2009 | Hupp |
| 7,735,529 | B2 | 6/2010 | Lawrence et al. |
| 7,743,798 | B2 | 6/2010 | Kunii et al. |
| 7,748,419 | B2 | 7/2010 | Benscoter et al. |
| 7,987,878 | B1 | 8/2011 | Imler |
| 8,631,837 | B2 | 1/2014 | Lauber |
| 9,126,820 | B2 | 9/2015 | Gray |
| 2004/0060612 | A1 | 4/2004 | Dame |
| 2006/0185759 | A1 | 8/2006 | Healy |
| 2007/0113922 | A1 | 5/2007 | Christman et al. |
| 2008/0295916 | A1 | 12/2008 | Bonner |
| 2012/0114819 | A1 | 5/2012 | Ragnarsson et al. |
| 2012/0125478 | A1 | 5/2012 | Clever |

OTHER PUBLICATIONS

Minivalve: Duckbill Valves. Webpage 1; Minivalve.com/newsite: downloaded Nov. 28, 2012 Nov. 18, 2012.

* cited by examiner

METHOD AND APPARATUS FOR REDUCING RESIDUAL FUEL IN A DISPENSING NOZZLE

This application claims priority under 35 U.S.C. §119 from the following provisional patent applications: U.S. Provisional Patent Application No. 61/873,959 for a DRIP LESS ONE (DL1) NOZZLE, filed Sep. 5, 2013 by D. Ramphal et al.; U.S. Provisional Patent Application No. 61/930,454 for a DRIP LESS NOZZLE WITH RESIDUAL FLOW PREVENTION, filed Jan. 22, 2014 by D. Ramphal et al.; and U.S. Provisional Patent Application No. 61/943,676 for a METHOD AND APPARATUS FOR REDUCING RESIDUAL FUEL IN A DISPENSING NOZZLE, filed Feb. 24, 2014 by D. Ramphal et al., and priority is also claimed as a continuation-in-part from related co-pending U.S. patent application Ser. No. 13/852,170 for a NON-DRIP NOZZLE, filed Mar. 28, 2013 by D. Ramphal et al., which claims the benefit of priority under 35 USC 119 (e) to U.S. Provisional Appl. No. 61/618,631, filed Mar. 30, 2012, and U.S. Provisional Appl. No. 61/676,097 filed Jul. 26, 2012, and U.S. Provisional Appl. No. 61/731,553, filed Nov. 30, 2012, and all of the above-listed applications are hereby incorporated by reference in their entirety.

The following disclosure relates to a method and apparatus for the dispensing of liquids (e.g., fuel). More particularly, the disclosed apparatus and method includes an improved nozzle that reduces residual liquid retained in the nozzle when dispensing is stopped (e.g., post-dispense), which may or may not be combined with other dripless nozzle features such as those disclosed in the pending U.S. patent application Ser. No. 13/852,170 for a NON-DRIP NOZZLE.

BACKGROUND & SUMMARY

Nozzles are commonly used for directing and controlling the flow rate of fluids being dispensed. Some nozzles are specifically designed for dispensing liquid fuels such as gasoline and diesel, for example the nozzles disclosed in U.S. Pat. Nos. 6,024,140 and 5,603,364, which are hereby incorporated by reference for their teachings. Fuel dispensing nozzles generally include a control lever with an associated valve, and a spout. The lever controls the flow of the fuel passing through the spout, and is often located below a handle so that a user is able to grasp the handle with the palm of the hand, and extend the fingers to control the lever, and thus, the flow rate. Typically such devices include an auto-shutoff feature whereby a diaphragm or similar mechanism is responsive to the level of fuel in the container being filled, and dispensing is disrupted when the fuel is at a level that occludes a vacuum orifice in or near the tip of the nozzle spout. A limitation of existing fuel nozzles is that a volume of fuel remains in the interior of the spout and the vacuum orifice once the handle is released. This residual or post-dispense fuel, as represented by the shaded portions in the nozzles and spouts illustrated in FIGS. 1-4, for example, often drops on the ground, the user, the user's vehicle, and/or evaporates into free air, leading to the potential of a significant environmental problem. As the figures illustrate there are several potential locations in which residual liquids such as fuel may reside after dispensing has stopped. In the case of fuel dispensing nozzles, gasoline and similar fuels contain volatile organic compounds (VOCs) as well as hazardous air pollutants (HAPs), both of which have been targeted for reduction and/or elimination by the U.S. Environmental Protection Agency (EPA). Accordingly, there is a need for a fluid dispensing nozzle that reduces the wasteful dripping of residual fuel.

Although various nozzle designs have been proposed for use in fuel dispensing systems, environmental and safety concerns continue to demand that nozzles found in gas stations be designed to prevent fuel from dripping from the spout of the nozzle after it is removed from the fluid receptacle (e.g., vehicle fuel tank). Current designs, while somewhat effective, still present disadvantages, hence they have not been generally accepted. For example, some nozzles require complex valves at the end of the spout.

There are a number of different attributes which contribute to dripping from a nozzle. Two often overlooked sources of dripping originate from the vacuum line and the diaphragm. Fuel enters into the vacuum channels due to suction from the venturi. This results in a source of residual fuel and potential dripping from the venturi/vacuum channel. Once pumping has finished fuel is often ejected from the vacuum channel and runs along the bottom of the spout resulting in delayed drips. This gives the appearance that dripping has originated from the end of the spout. Dripping from the diaphragm occurs when fuel enters the diaphragm and adjacent air channels through the venturi. As the diaphragm displaces, mimicking a 'syringe,' causing the diaphragm to draw fuel through the venturi into the diaphragm and any adjacent vacuum channels. This residual fuel then results in delayed drips after the user has finished pumping.

Disclosed in embodiments herein is a liquid-dispensing apparatus having a spout, comprising: a main channel for directing the flow of a supply of liquid from an inlet end of the spout to a discharge end of the spout; a vacuum channel operatively associated with the dispensing apparatus, said vacuum channel having an open end in proximity with the discharge end of the spout and connecting to, and providing a source of intended fluid (e.g., vapor) to, at least one venturi located in proximity to the inlet end of the spout, where the vacuum channel further includes a fluid-sensitive valve proximate to the open end of the vacuum channel, and where said fluid-sensitive valve includes a movable stopper that may occupy a static position (when no flow of gas or liquid through the valve), an operating position (allowing air flow through the valve), and a closed position (where liquid is prevented from flowing through the valve); and at least one check-valve associated with the at least one venturi, wherein the check-valve prevents the backflow of fluid through the venturi.

Further disclosed in embodiments herein is a liquid-dispensing apparatus having a spout, comprising: a main channel for directing the flow of a supply of liquid from an inlet end of the spout to a discharge end of the spout; a vacuum channel operatively associated with the dispensing apparatus, said vacuum channel having an open end in proximity with the discharge end of the spout and connecting to, and providing a source of intended fluid to, at least one venturi located in proximity to the inlet end of the spout, wherein the vacuum channel further includes a fluid sensitive valve proximate to the open end of the vacuum channel system, where said valve includes a movable stopper that may occupy a static position (when there is no flow of fluid (liquid or gas) through the valve), an operating position (where fluid flow through the valve is under desired conditions), and a closed position (where flow conditions are no longer desirable, such that closing the valve is initiated and completed by undesirable flow (e.g., a change in viscosity, density, momentum, liquid-solid adhesion properties, etc.); and at least one check-valve associated with the at least one venturi, wherein the check-valve prevents the backflow of fluid and air through the venturi.

Also disclosed herein is a method for reducing the presence of liquid in a liquid-dispensing apparatus having a spout, and the spout having a main channel for directing the flow of a supply of liquid from an inlet end of the spout to a discharge end of the spout, the method comprising: providing a vacuum channel operatively associated with the liquid-dispensing apparatus, said vacuum channel having an open end in proximity with the discharge end of the spout and connecting to, and providing a source of intended fluid to a venturi(s) located in proximity to the inlet end of the spout; attaching a fluid-sensitive valve to the vacuum channel, proximate the open end of the vacuum channel, where said fluid-sensitive valve includes a movable stopper that may occupy a static position (when no flow of gas or liquid through the valve), an operating position (allowing air flow through the valve), and a closed position (where liquid is prevented from flowing through the valve); and inserting a check-valve in each venturi, wherein the check-valve prevents the backflow of fluid and air through the venturi.

Figure 1:
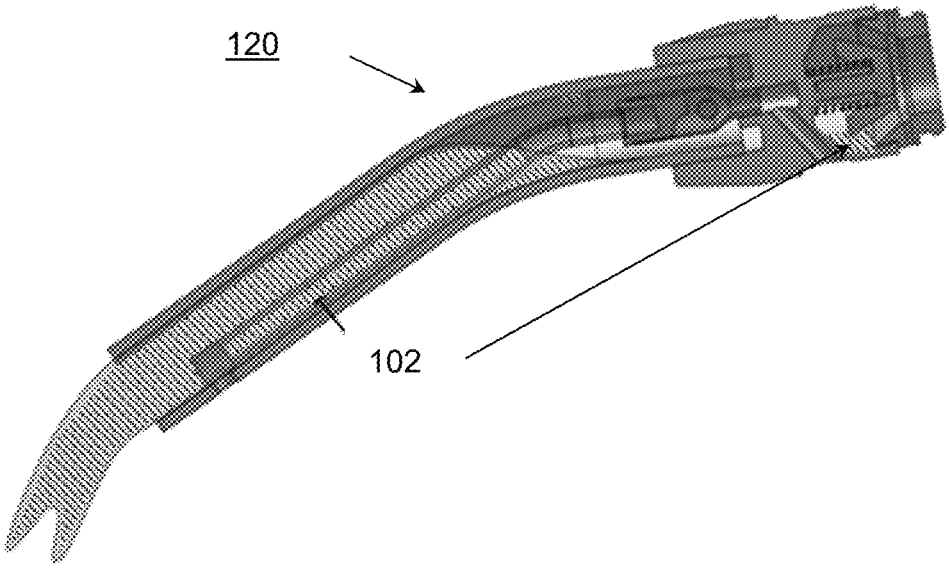
FIGS. 1-4 are illustrative examples of fuel dispensing spouts or nozzles illustrating the locations in which residual fluid may remain after fuel dispensing has ceased.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Figure 2:
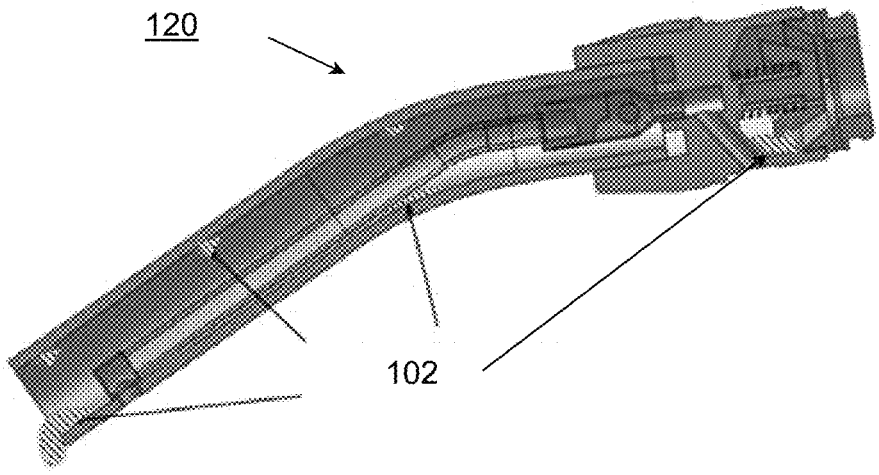
Figure 3:
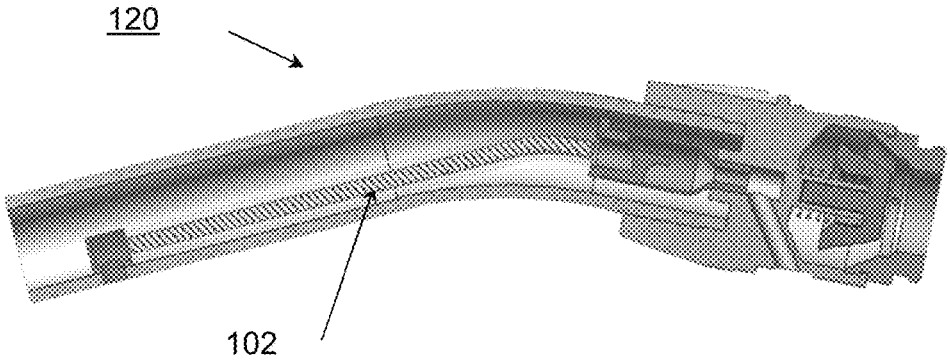

As noted above, residual or post-dispense fuel remains in fuel nozzles immediately after dispensing is stopped, and in some cases that fuel remains after the nozzle is removed from the fill location, causing the fuel to drip on the ground, vehicles and clothing of users. The residual fuel, as represented by the shaded portions in the nozzles and spouts illustrated in FIGS. 1-4, also evaporates into free air, leading to the potential of a significant environmental problem. More specifically, FIG. 1 illustrates where residual fuel 102 is in the nozzle immediately after dispensing is stopped. FIG. 2 illustrates the same nozzle several seconds later (e.g., 1-3 seconds). And, FIG. 3 further depicts the residual fuel that remains in the vacuum channel 130 after shut-off. One aspect of the disclosed embodiments is the elimination and control of residual fuel in a vacuum channel (e.g., tube 130) that is used to trigger the auto-shutoff mechanism found in many fuel dispensing nozzles.

Figure 4:
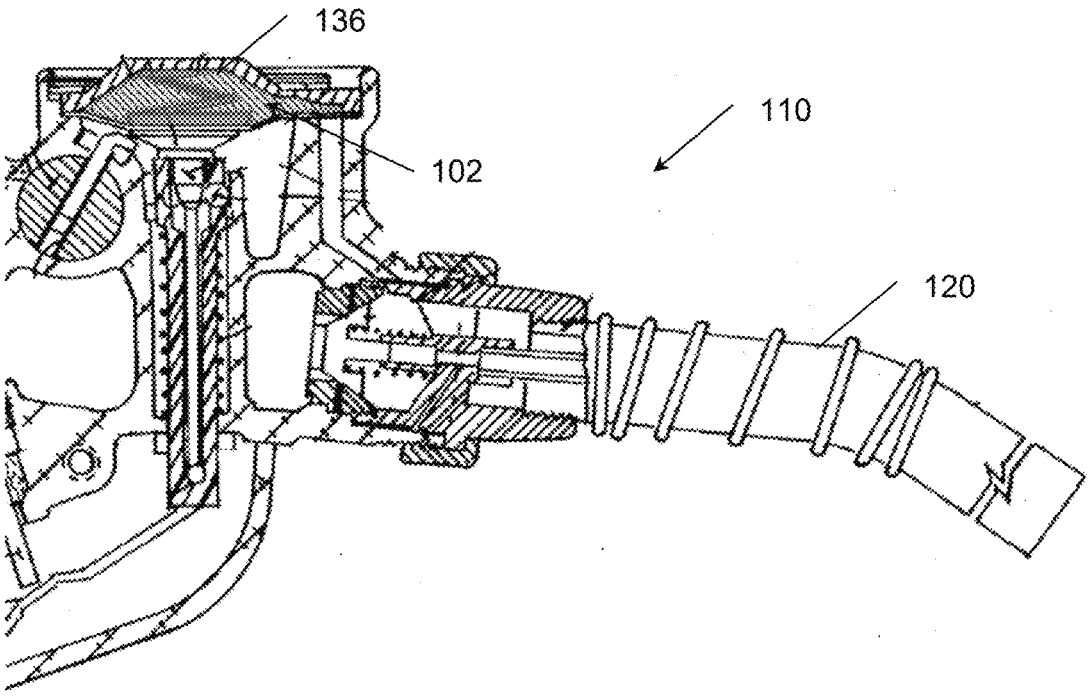
Figure 5A:
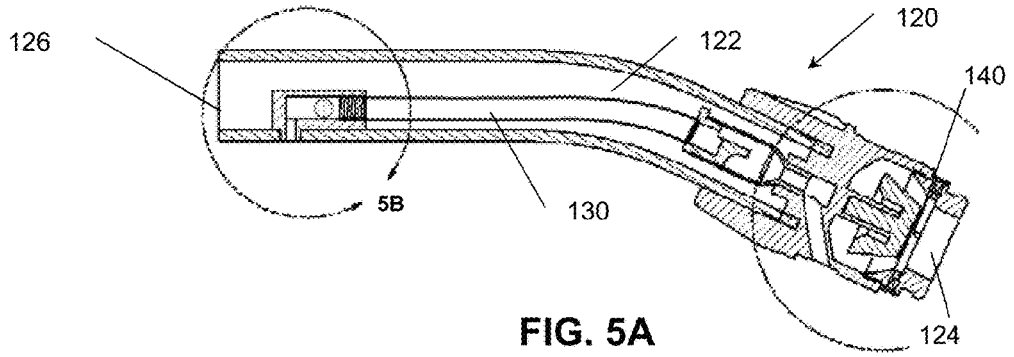
FIGS. 5A-8 are illustrations of embodiments of a fluid sensitive valve and housing in accordance with an aspect of the disclosed embodiments.
Figure 5B:
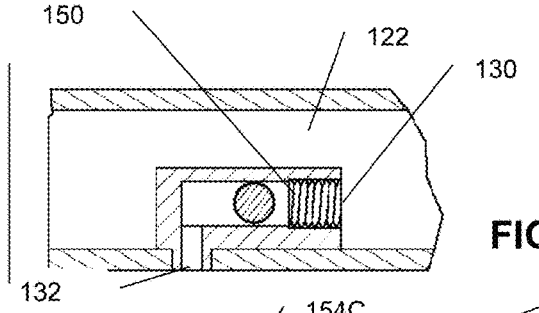
Figure 6:
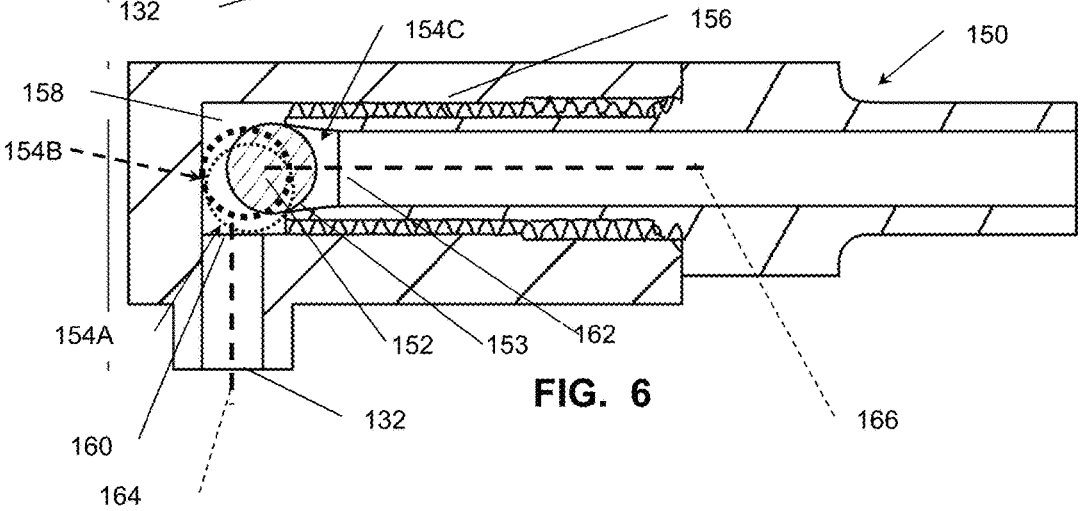

Referring to FIGS. 4-6, depicted is a liquid-dispensing apparatus 110 having a spout 120. The spout includes a main channel 122 for directing the flow of a supply of liquid from an inlet end (124) of the spout to a discharge end (126) of the spout. A vacuum channel 130 is operatively associated with the dispensing apparatus, the vacuum channel having an open end in proximity with the discharge end of the spout 126 and connecting to, and providing a source of intended fluid to, at least one venturi 140 located in proximity to the inlet end of the spout 124. The vacuum channel further includes a fluid-sensitive valve 150 proximate to the open end 132 of the vacuum channel, where the fluid-sensitive valve includes a movable stopper 152 that may occupy a static position 154A (when no flow of gas or liquid through the valve), an operating position 154B (allowing fluid flow through the valve), and a closed position 154C (where fluid is prevented from flowing through the valve)—all illustrated in FIG. 9).

Figure 12:
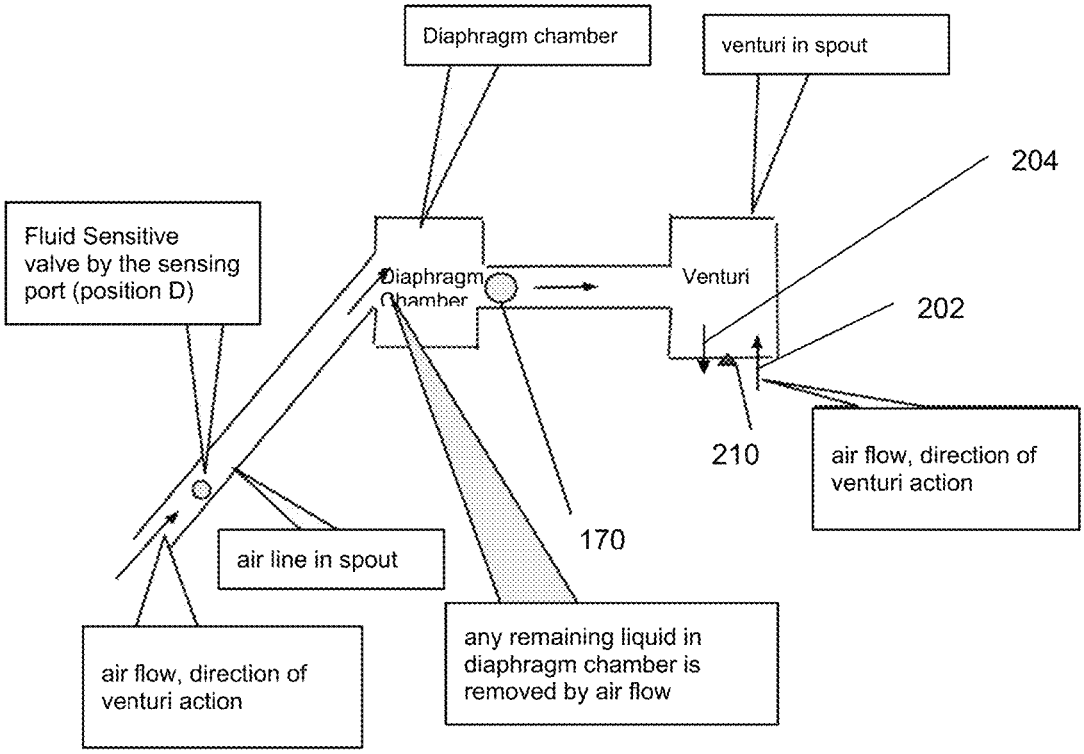
FIG. 12 is a detailed schematic of the components according to an embodiment disclosed.

As illustrated schematically in FIG. 12, to address the residual fuel collection, the apparatus may include at least one check-valve 210 associated with the at least one venturi 140. In one embodiment, check-valve 210 prevents the backflow of liquid and air through the venturi. The check valve 210 may be in the form of a small duck-bill type valve, a fluid sensitive valve, or similar mechanism that enables intended fluid to be drawn through the venturi when there is a positive pressure differential across the valve, but prohibits the flow of fluid or air in the opposite direction when there is no pressure or a negative pressure. In one embodiment, the duck bill check valve is a fluoro-silicone material and provides negligible resistance to air flow through the venturi(es) It will also be appreciated that the duck bill valve may be a standard valve or may have a pre-load or cracking pressure. If a pre-load valve is used, it should present a minimal force necessary so as not in interfere with the venturi action. Pre-loaded valves are "normally closed" and a normally open (e.g., standard) valve will have some small amount of leakage when pressure is applied in the reverse direction, until enough pressure is applied to force the valve shut. A normally closed pre-loaded valve does not require reverse pressure to seal.

Figure 7:
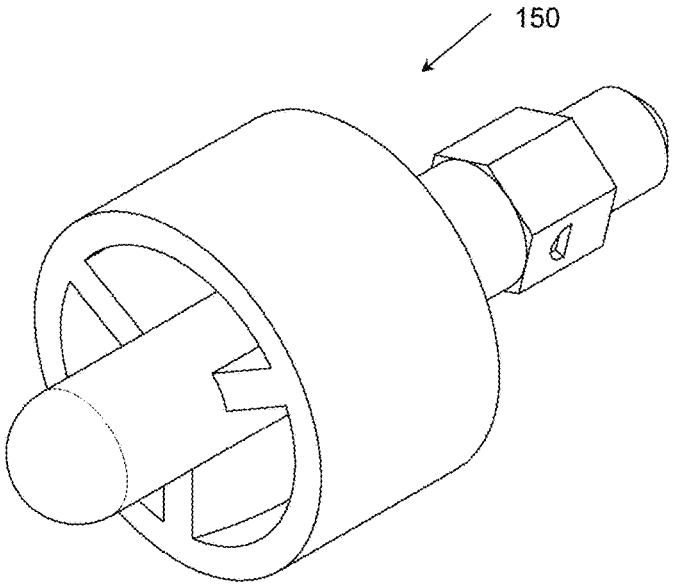
Figure 8:
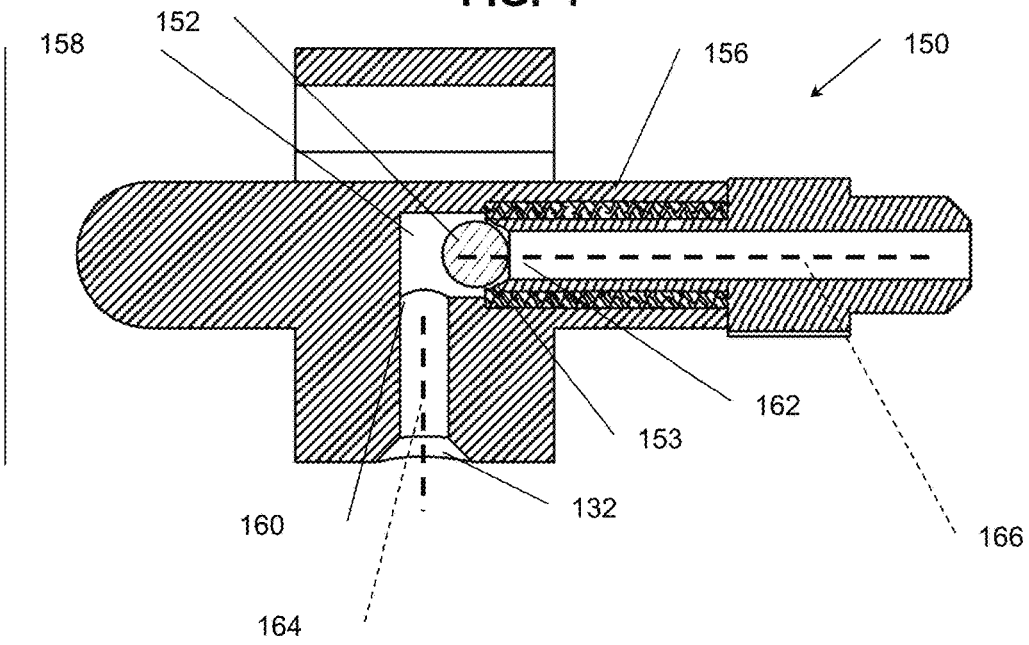

Turning again to FIGS. 6-8, the details and operation of several exemplary embodiments of fluid-sensitive valve 150 will be described. More specifically, FIG. 6 is intended to be an enlarged, cross-sectional view of the valve depicted in FIGS. 5A and 5B. FIGS. 7 and 8 are, respectively, perspective and cross-sectional views of an alternative valve design suitable for use in a Husky stream shaper spout embodiment.

In each of the embodiments depicted, the fluid-sensitive valve 150 comprises a valve body 156 having an interior chamber 158, where the interior chamber has an inlet opening 160 and an outlet opening 162. Moreover, when the spout is inserted into a fluid receptacle, inlet opening 160 is open to the interior of the fluid receptacle through the channel and external opening 132. The second or outlet opening 162 is connected to the vacuum channel 130. The outlet opening 162 includes a seat (e.g., chamfer) 153 to catch and guide the movable stopper 152 into the closed position when fluid enters the inlet or first opening 160 and undesirable flow conditions occur.

As illustrated in both valve housing designs depicted in FIGS. 6-8, the fluid-sensitive valve 150 further comprises an interior chamber design wherein the inlet opening 164 and valve body 156 are designed such that the movable stopper cannot occlude the inlet opening 160 no matter the orientation and position of the stopper 152. It will be appreciated that there are several alternative configurations to prevent the moveable stopper from inhibiting fluid flow into the valve, including mismatch of hole and stopper geometry (such as a spherical ball and a non-round hole (e.g., oval, square, slit etc.); location of the hole as done in one embodiment disclosed herein (e.g., close to the front wall); or even multiple holes so the stopper could only occlude one at a time.

Figure 9:
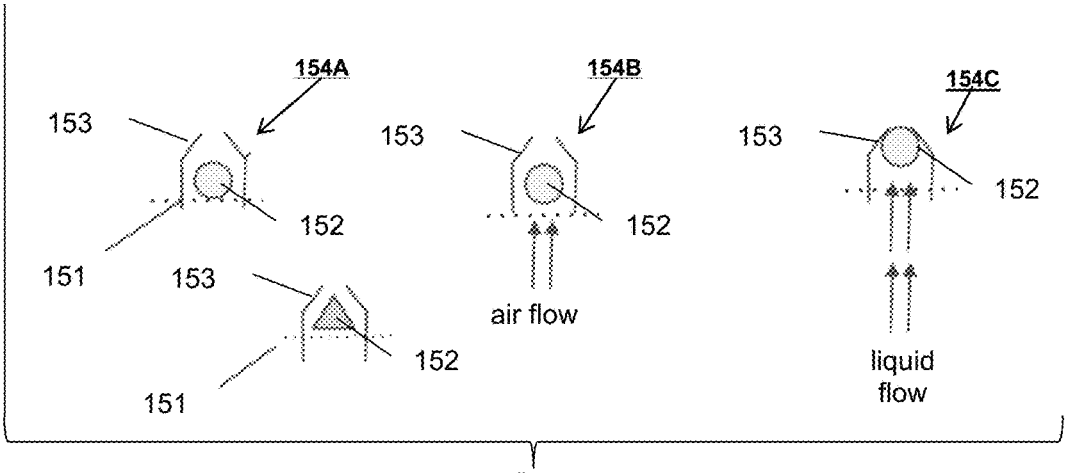
FIG. 9 is an illustration of the various positions of a movable stopper in the fluid-sensitive valve.

As a further illustration of the various possible positions of the stopper relative to the inlet and outlet openings, FIG. 9 is provided. In another embodiment, the movable stopper may be retained near the outlet opening by a structure such as a mesh 151. As will be appreciated, the fluid-sensitive valve 150 prevents or minimizes residual fluid from entering into vacuum channels 130 and/or a diaphragm 136 associated with the dispensing apparatus 110. And, as illustrated in FIG. 9, the movable stopper 152 and seat 153 operate cooperatively by design to move the fluid-sensitive valve to the closed position when undesired flow conditions occur.

The movable stopper 152 is designed to achieve displacement of the stopper into contact with the seat in the presence of the undesired flow conditions. The stopper design characteristics include a stopper material, where a combination of one or more features such as density, porosity, surface energy, and buoyancy etc. are combined to provide a desirable material. Furthermore, the stopper's geometry (e.g., shape, size, etc.) and orientation (e.g., flow-facing profile, etc.) are similarly selected to assure the stopper moves into contact with the seat in the presence of undesirable flow conditions such as liquid moving into the chamber inlet 160. For example, stopper material density could be selected relative to the fluid entering the valve in undesirable flow conditions, thereby assisting in closing the stopper against the seat preferentially through buoyancy. Alternatively, an oleophobic coated stopper would allow flow of hydrocarbons without displacing the stopper (operating condition), but displace the stopper when water enters the valve (initiating closed position) due to differences in surface energy interactions between the stopper and different fluids.

Continuing to refer to FIGS. 6-9, the seat is provided with means to allow the stopper to unseat and reset to the "static" (154A) or "operating" (154B) position rapidly following initiation of the closed position 154C, subsequent to the fluid sensitive valve entering the closed position. In some applications it may be desirable that the valve (i.e., moveable stopper 152) reset to the "operating" or "static" position rapidly following initiation of the "closed" position. This allows the fluid sensitive valve to cycle rapidly between operating and closed positions without impacting performance of the dispensing apparatus. For example one means by which this is accomplished using a small geometrical deviation in the seat which partially disrupts the otherwise effective fluid-tight seal of the stopper on the seat in the closed position; this deviation allows pressure to equalize on the upstream and downstream sides of the stopper-seat interface, even in the closed position. This pressure equalization alleviates any pressure differential which may serve to hold the ball within its seat, thereby allowing the stopper to unseat by means of gravity or other biasing force acting on the ball. The biasing force could similarly be achieved by means of a spring acting on the stopper, biasing it to the "static" or "operating" state. A third means considered is a hydrophobic coated ball, an oleophobic coated ball, a hydrophobic seat, or an oleophobic coated seat, or both, which may assist the stopper in resetting. The coated phobic surface(s) reduce the adhesion forces between the ball, the seat and the liquid allowing the moveable stopper to return to the operating or static position.

Figure 10:
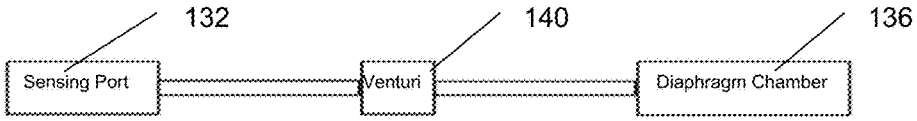
FIGS. 10 and 11 are, respectively, schematic illustrations of the vacuum channel system including an existing implementation included for reference and an improved configuration to assist in prevention of residual fuel
Figure 11:
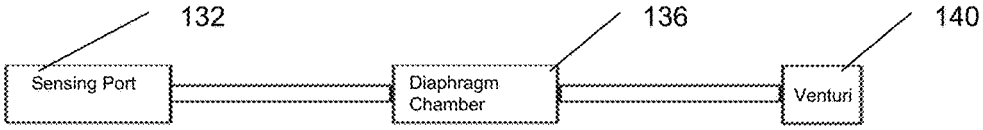
Figure 13:
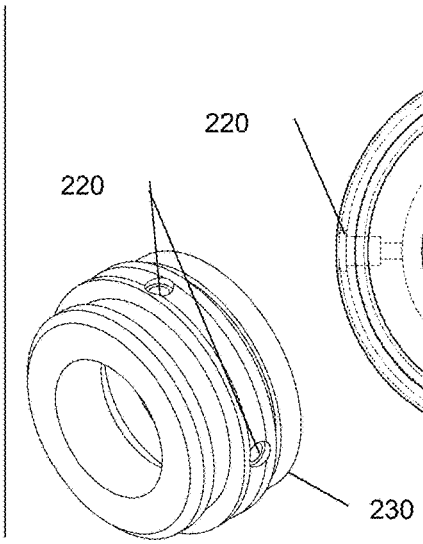
FIGS. 13-15 are perspective, top and cross-sectional views of a venturi assembly in accordance with one nozzle type (e.g., OPW)
Figure 14:
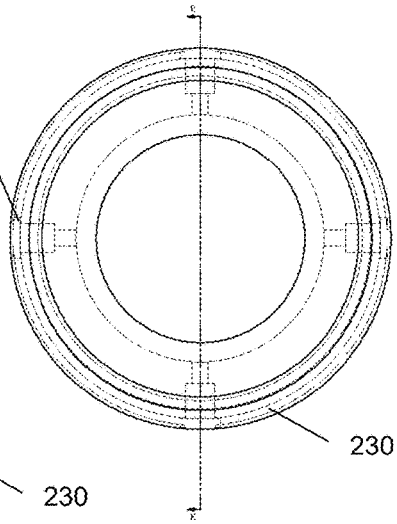
Figure 15:
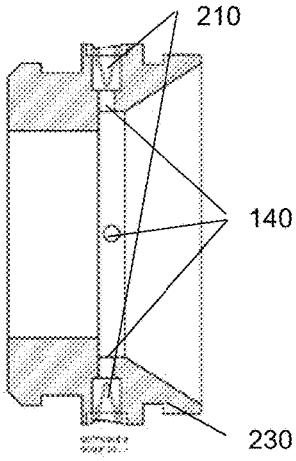

In an alternative embodiment the configuration (e.g., relative order) of the air channel, venturi, and the diaphragm chamber may be modified. In one commonly used configuration, as depicted in FIG. 10, the venturi is between the sensing port and the diaphragm chamber. A simplified view of this typical configuration is shown where the venturi 140 is between the sensing port 132 and the diaphragm 136. In contrast, the alternative embodiment of FIG. 11 places the diaphragm chamber 136 between the sensing port 132 and the venturi 140. As more specifically illustrated in FIGS. 12-15, this embodiment places a fluid sensitive valve at the sensing port (position D). A check valve may also be placed by the diaphragm chamber (position E), and this valve may be a fluid sensitive valve such as valve 150 or a duck bill valve 140 or similar. Duck bill valves 140 may also be placed in or in line with the venturi holes 220 (Position F), as more specifically illustrated in FIGS. 13-15. The duck bill valves associated with the venturi act to allow flow in the direction of the venturi action (arrow 202), and block flow in the opposite direction (arrow 204). These valves prevent fuel from being suctioned into the air channel after shutoff occurs. One advantage of this alternative embodiment is that any liquid remaining in the diaphragm chamber will be removed by the flow of air through that chamber, which is believed to result in a more precise auto shutoff function with respect to the dispensing apparatus and the remaining conventional hardware/components. It should also be noted that simply implementing this alternative configuration of the sensing port 132, venturi 140, and diaphragm 136 would be advantageous to nozzle operation and reduction of residual fuel even without the addition of the fluid sensitive valve 150 and duck bill valves 140; these additional components further improve performance.

Figure 16:
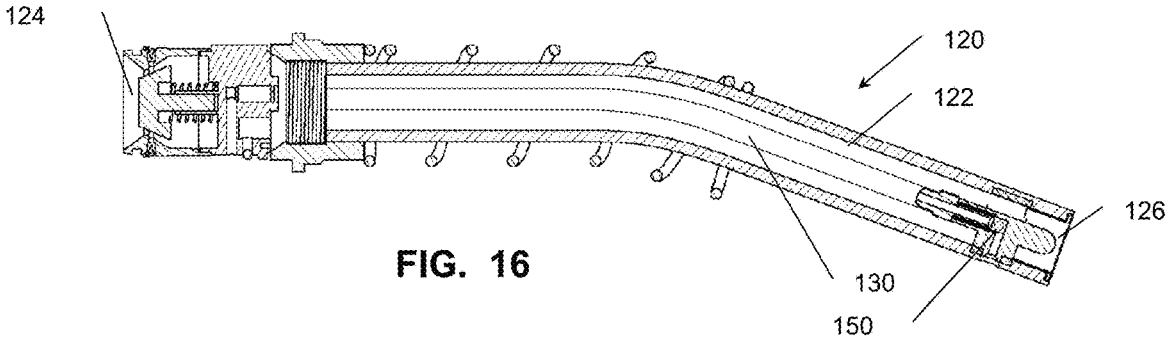
FIGS. 16-18 are views of an alternative nozzle type (e.g., Husky), showing the spout side view, venturi assembly top view and cross section, respectively.
Figure 17:
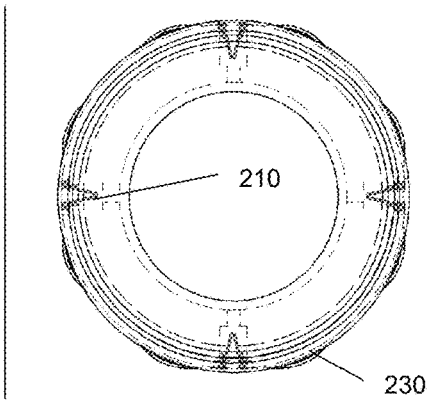
Figure 18:
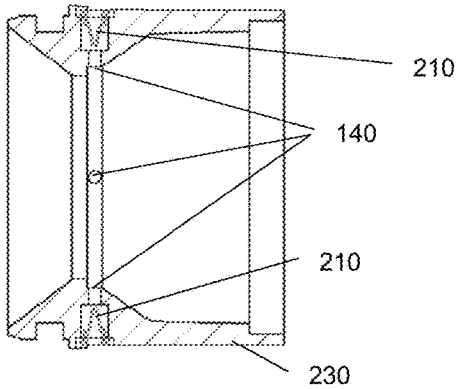

As further illustrated in FIGS. 16-18, the disclosed embodiments may be adapted for use with various fuel dispensing nozzles, including those manufactured by Husky. More specifically, FIG. 16 is a side, cross-sectional view of an exemplary embodiment for a liquid-dispensing apparatus 110 having a spout 120. The apparatus further comprises a main channel 122 for directing the flow of a supply of liquid (not shown) from an inlet end of the spout 124 to a discharge end of the spout 126. Also included is a vacuum channel 130 operatively associated with the dispensing apparatus, where the vacuum channel has an open end 132 in proximity with the discharge end of the spout 126 and connecting to, and providing a source of intended fluid to, at least one venturi 220 located in a venturi assembly 230 in proximity to the inlet end of the spout. The vacuum channel further includes a fluid-sensitive valve 150 proximate to the open end of the vacuum channel, where the fluid-sensitive valve includes a movable stopper 152 that may occupy a static position, an operating position, and a closed position, such that closing the fluid-sensitive valve is initiated and completed by undesirable flow (e.g., a change in viscosity, density, momentum, liquid-solid adhesion properties, etc.). And, the alternative embodiment also includes at least one check-valve 210 associated with at least one venturi, where the check-valve prevents the backflow of fluid through the venturi when a flow of liquid in the main channel has stopped.

One aspect of the disclosed embodiments is that the check valve components or features operate in combination with one another to achieve further improvements in preventing the release and dripping from fuel that is retained in the vacuum channel, diaphragm chamber, etc. More specifically, the inclusion of say just the duck bill check valves in the venturies alone would create a vacuum in that channel trapping liquid in it; liquid that could then be released upon movement of the dispensing nozzle spout. Similarly, using just the fluid-sensitive valve would only trap back flow through the venturies, and would cause the vacuum channel to release its retained fluid slowly. And, the fluid-sensitive valve enables what is essentially a dry shutoff, whereby the valve itself causes blockage of the vacuum channel (versus the presence of liquid in conventional auto-shutoff nozzles). Thus, it is the synergistic relationship between the disclosed check valves, positioned at essentially the opposite ends of the vacuum channel, which serve to reduce or eliminate residual fluid in the channel post-shutoff as well as to reliably retain whatever fluid may remain there.

It will be further appreciated that a method of assembling and operating the apparatus described above may include the following steps or operations to reduce the presence of liquid (e.g., residual liquid) in a liquid-dispensing apparatus having a spout, and the spout having a main channel for directing the flow of a supply of liquid from an inlet end of the spout to a discharge end of the spout. More specifically, the method includes providing a vacuum channel operatively associated with the liquid-dispensing apparatus. The vacuum channel has an open end in proximity with the discharge end of the spout, and the vacuum channel is connected to and provides a source of intended fluid to a venturi(s) located in proximity to the inlet end of the spout. A fluid-sensitive valve is attached to the vacuum channel, proximate the open end of the vacuum channel, where the fluid-sensitive valve includes a movable stopper that may occupy one of several positions as described above and depicted in FIG. 9. The apparatus also has a check-valve inserted in line with each venturi, such that the check-valve prevents the backflow of fluid through the venturi when a flow of liquid in the main channel has stopped.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

LISTING OF REFERENCE NUMERALS

102 residual fuel
110 liquid-dispensing apparatus
120 spout
122 main channel
124 inlet end of the spout
126 discharge end of the spout
130 vacuum channel
132 sensing port/open end of the vacuum channel
136 diaphragm
140 venturi
150 fluid-sensitive valve
152 movable stopper
153 valve seat
154A static position, 154B operating position, and 154C closed position
156 valve body
158 interior chamber
160 inlet opening
162 outlet opening
164 inlet opening axis
166 outlet opening axis
170 check valve
202 arrow-in through venturi
204 arrow-backflow
210 duck bill valve
220 venturi holes
230 venturi assembly

What is claimed is:

1. A liquid-dispensing apparatus having a spout, comprising:

a main channel for directing the flow of a supply of liquid from an inlet end of the spout to a discharge end of the spout;

a vacuum channel operatively associated with the dispensing apparatus, said vacuum channel having an open end in proximity with the discharge end of the spout and connecting to, and providing a source of intended fluid to, at least one venturi located in proximity to the inlet end of the spout, where the vacuum channel further includes a fluid-sensitive valve proximate to the open end of the vacuum channel, and where said fluid-sensitive valve includes a movable stopper that may occupy a static position, an operating position, and a closed position; and at least one check-valve associated with the at least one venturi, wherein the check-valve prevents a backflow of fluid through the venturi.

2. The dispensing apparatus according to claim 1, wherein said fluid-sensitive valve comprises:

a valve body;

an interior chamber having first and second openings, the first opening is, when said spout is inserted into a fluid receptacle, open to the interior of the fluid receptacle and where the second opening is connected to the channel;

the second opening including a seat to catch and guide the movable stopper into the closed position when fluid enters the first opening and undesirable flow conditions occur.

3. The dispensing apparatus according to claim 1, wherein a configuration of the valve body is such that the movable stopper cannot occlude the inlet opening, regardless of the orientation and position of the stopper (e.g., said fluid-sensitive valve further comprises a chamber design wherein the first opening is at an angle (e.g. a right angle) relative to the second opening).

4. The dispensing apparatus according to claim 1, wherein said check-valve prevents residual fluid from entering into vacuum channels and a diaphragm associated with the apparatus.

5. The dispensing system according to claim 1, wherein the movable stopper and seat operate cooperatively to move the fluid-sensitive valve to the closed position when undesired flow conditions occur.

6. The dispensing system according to claim 1, wherein the movable stopper includes a stopper material, geometry and orientation selected to achieve displacement of the stopper into the seat in the presence of the undesired flow conditions.

7. The dispensing system according to claim 5, wherein the seat is provided with means to allow the stopper to unseat and reset to the "static" or "operating" position rapidly, following initiation of the closed position.

8. The dispensing system according to claim 1, wherein said system comprises at least one duck bill-type check-valve associated with each of the at least one venturi, such that the vacuum channel employs both the fluid-sensitive valve adjacent an open end of the vacuum channel in proximity with the discharge end of the spout to stop the flow of both air and fluid through the vacuum channel in response to the presence of fluid and the duck bill-type check-valve to prevent the backflow of fluid and air through the venturi into the vacuum channel.

9. The dispensing system according to claim 8, wherein said duck bill-type check-valve includes a pre-load.

10. The dispensing system according to claim 9, wherein the vacuum channel operatively associated with the dispensing apparatus, is at least partially enclosed within the main channel of the spout.

11. A fuel-dispensing nozzle having a spout for reducing post-dispense residual fuel remaining in and dripping from the nozzle, comprising:

a main channel for directing the flow of a supply of liquid from an inlet end of the spout to a discharge end of the spout;

a vacuum channel operatively associated with the dispensing apparatus, said vacuum channel having an open end in proximity with the discharge end of the spout and connecting to, and providing a source of intended fluid to, at least one venturi located in proximity to the inlet end of the spout, wherein the vacuum channel further includes a fluid sensitive valve proximate to the open end of the vacuum channel system, where said valve includes a movable stopper that occupies one of a static position, an operating position, and a closed position; and at least one check-valve associated with the at least one venturi, wherein the check-valve prevents a backflow of fluid and air through the venturi when a flow of liquid in the main channel has stopped.

12. The dispensing system according to claim 11, wherein said system comprises at least one duck bill-type check-valve associated with each of the at least one venturi, such that the vacuum channel employs both the fluid-sensitive valve adjacent an open end of the vacuum channel in proximity with the discharge end of the spout to stop the flow of both air and fluid through the vacuum channel in response to the presence of fluid and the duck bill-type check-valve to prevent the backflow of fluid and air through the venturi into the vacuum channel.

13. The dispensing system according to claim 12, wherein said duck bill-type check-valve includes a pre-load.

14. The dispensing system according to claim 13, wherein the vacuum channel operatively associated with the dispensing apparatus, is at least partially enclosed within the main channel of the spout.

15. In a liquid-dispensing apparatus having a spout, and the spout having a main channel for directing the flow of a supply of liquid from an inlet end of the spout to a discharge end of the spout, a method for reducing the presence of liquid in the apparatus after dispensing, comprising:

providing a vacuum channel operatively associated with the liquid-dispensing apparatus, said vacuum channel having an open end in proximity with the discharge end of the spout and connecting to, and providing a source of intended fluid to, at least one venturi located in proximity to the inlet end of the spout;

attaching a fluid-sensitive valve to the vacuum channel, proximate the open end of the vacuum channel, where said fluid-sensitive valve includes a movable stopper that occupies at least one of a static position, an operating position, and a closed position so as to prevent the introduction of fuel into the vacuum channel once the stopper is in the closed position; and employing a duck bill type check-valve in each of the at least one venturi, wherein the check-valve prevents the backflow of fluid and air through the venturi after a flow of liquid in the main channel has stopped.

16. The method according to claim 15, wherein said vacuum channel employs the fluid-sensitive valve adjacent an open end of the vacuum channel in proximity with the discharge end of the spout to stop the flow of both air and fluid through the vacuum channel in response to the presence of fluid, and the duck bill-type check-valve to prevent the backflow of fluid and air through the venturi into the vacuum channel.

17. The dispensing system according to claim 16, wherein said duck bill-type check-valve includes a pre-load.

18. The dispensing system according to claim 17, wherein the vacuum channel operatively associated with the dispensing apparatus, is at least partially enclosed within the main channel of the spout.

* * * * *